US008542171B2

(12) United States Patent
Huang et al.

(10) Patent No.: US 8,542,171 B2
(45) Date of Patent: Sep. 24, 2013

(54) LIQUID CRYSTAL DISPLAY AND DRIVING METHOD THEREOF

(75) Inventors: Hsueh-Ying Huang, Hsin-Chu (TW); Ming-Sheng Lai, Hsin-Chu (TW); Min-Feng Chiang, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1022 days.

(21) Appl. No.: 11/822,801

(22) Filed: Jul. 10, 2007

(65) Prior Publication Data

US 2008/0074370 A1 Mar. 27, 2008

(30) Foreign Application Priority Data

Sep. 21, 2006 (TW) ..... 95135024 A

(51) Int. Cl.
*G09G 3/36* (2006.01)

(52) U.S. Cl.
USPC ..... 345/88; 345/102

(58) Field of Classification Search
USPC ..... 345/84, 87, 88, 89, 94, 208, 690, 345/102, 204
See application file for complete search history.

(56) References Cited

U.S. PATENT DOCUMENTS

| | | | | |
|---|---|---|---|---|
| 5,233,338 | A | 8/1993 | Surguy | |
| 6,509,887 | B1 * | 1/2003 | Kondoh et al. | 345/87 |
| 6,927,766 | B2 * | 8/2005 | Tagawa et al. | 345/204 |
| 6,965,367 | B2 * | 11/2005 | Tanaka et al. | 345/102 |
| 7,532,210 | B2 * | 5/2009 | Chen et al. | 345/208 |
| 2002/0044113 | A1 * | 4/2002 | Ishiyama | 345/87 |
| 2002/0057241 | A1 * | 5/2002 | Oda et al. | 345/87 |
| 2003/0011553 | A1 * | 1/2003 | Ozaki | 345/89 |
| 2005/0062708 | A1 | 3/2005 | Yoshihara et al. | |
| 2006/0119566 | A1 * | 6/2006 | Sato et al. | 345/102 |
| 2006/0139302 | A1 * | 6/2006 | Chen et al. | 345/102 |

FOREIGN PATENT DOCUMENTS

| | | |
|---|---|---|
| CN | 1379386 A | 11/2002 |
| JP | 2002-082654 | 3/2002 |
| JP | 2002-287112 | 10/2002 |
| TW | 200630563 | 9/2006 |

* cited by examiner

*Primary Examiner* — Chanh Nguyen
*Assistant Examiner* — Pageman Karimi
(74) *Attorney, Agent, or Firm* — Rabin & Berdo, P.C.

(57) ABSTRACT

A driving method applied to a liquid crystal display. First, a first pixel voltage is outputted to a first pixel in a first row of pixels to change a transmittance of the first pixel. Next, a second pixel voltage is outputted to a second pixel in a second row of pixels to change a transmittance of the second pixel. Then, a backlight module is turned on. Next, at a first predetermined time point after the first pixel voltage is outputted, a pixel electrode voltage of the first pixel is adjusted. Finally, at a second predetermined time point after the second pixel voltage is outputted, a pixel electrode voltage of the second pixel is adjusted. The second predetermined time point follows the first predetermined time point.

28 Claims, 14 Drawing Sheets

LIQUID CRYSTAL DISPLAY AND DRIVING METHOD THEREOF

This application claims the benefit of Taiwan Patent Application Serial No. 95135024, filed Sep. 21, 2006, the subject matter of which is incorporated herein by reference.

BACKGROUND OF THE INVENTION

1. Field of the Invention

The invention relates in general to a liquid crystal display and a driving method thereof, and more particularly to a color sequence liquid crystal display and a driving method thereof.

2. Description of the Related Art

With the rapidly developed image display technology, the liquid crystal display, which is thin and light weighted and has the low electromagnetic radiation, has become a mainstream display product.

A color sequence liquid crystal display sequentially displays three primary color components of one pixel to represent the color. Three light-emitting sources for respectively outputting red, green, and blue light serve as a backlight source for each pixel of this color sequence liquid crystal display. In one frame time, sub-pixels of the pixels sequentially display three sets of data, and respectively and correspondingly output the red, green, and blue light. A person can recognize the color of this pixel according to his/her persistence of vision.

However, the color sequence liquid crystal display has to feed one set of image data to the pixel in three times. So, the driving frequency of the pixel has to be increased from the original 60 Hz to 180 Hz. As for the color sequence liquid crystal display, the driving frequency of the pixel is increased to 180 Hz. That is, the driving voltage for the liquid crystal has to be updated every 5.56 milliseconds (ms). The time of 5.56 ms includes the time when the backlight module lights up, and the liquid crystal molecule has to finish the response before the backlight module lights up, so the allowable response time of the liquid crystal molecule is substantially shorter than 5.56 ms.

FIG. 1A shows a relationship between time and a transmittance of a conventional liquid crystal display panel. As shown in FIG. 1A, T1 represents a transmittance of a first pixel, and Tn represents a transmittance of an $N^{th}$ pixel. The first pixel is located in a first row of pixels of the pixel array, and the $N^{th}$ pixel is located in an $N^{th}$ row of pixels of the pixel array. First, a corresponding pixel voltage is provided to the first pixel to make a maximum transmittance of the first pixel substantially equal a predetermined transmittance $T_{Max}$. Then, a corresponding pixel voltage is provided to the $N^{th}$ pixel at a time point t1 to make a maximum transmittance of the $N^{th}$ pixel substantially equal the predetermined transmittance $T_{Max}$. Thereafter, the backlight module is turned on between time points t2 to t3. As shown in FIG. 1A, at the time point t2 when the backlight module is turned on, the liquid crystal molecules of the $N^{th}$ pixel do not respond completely. That is, the transmittance of the $N^{th}$ pixel at time point t2 is substantially smaller than the predetermined transmittance $T_{Max}$. The pixels in different rows receive the pixel voltages at different time points, and the pixel closer to the bottom of the panel receives the pixel voltage later, so the liquid crystal molecules thereof respond later. When the backlight module is turned on, the liquid crystal molecules on the bottom of the panel have not responded completely yet while the liquid crystal molecules on the top of the panel have responded completely, so the upper and lower portions of the liquid crystal display panel have different luminance.

FIG. 1B shows gamma curves of the liquid crystal display panel of FIG. 1A. In addition, as shown in FIG. 1B, the difference between the transmittances of the first pixel P1 and the $N^{th}$ pixel Pn at the first reference gray level G1 is $\Delta L_1$, and the difference between the transmittances of the first pixel P1 and the $N^{th}$ pixel Pn at the second reference gray level G2 is $\Delta L_2$. As shown in FIG. 1B, $\Delta L_1$ and $\Delta L_2$ are far greater than zero, which means that the gamma curve of the first pixel P1 are not coincide with the gamma curve of the first pixel P2, which leads to the shifting of gamma curve.

It is a subject of the panel manufacturer to improve the phenomenon of the non-uniform luminance of the liquid crystal display panel caused by the fact that the pixels in different rows are scanned and enabled in different time points, and thus to reduce the shifting of the gamma curve.

SUMMARY OF THE INVENTION

The invention is directed to a liquid crystal display and a driving method thereof to improve the phenomenon of the non-uniform luminance of a liquid crystal display panel and reduce the shifting of the gamma curve.

According to a first aspect of the present invention, a driving method applied to a liquid crystal display is provided. The liquid crystal display includes a backlight module and a pixel array which includes a first row of pixels and a second row of pixels. The method includes the following steps. First, a first pixel voltage is outputted to a first pixel in a first row of pixels in order to change a transmittance of the first pixel. Next, a second pixel voltage is outputted to a second pixel in a second row of pixels to change a transmittance of the second pixel. Then, a backlight module is turned on. Next, at a first predetermined time point after the first pixel voltage is outputted, a pixel electrode voltage of the first pixel is adjusted in order to lower the transmittance of the first pixel. After that, at a second predetermined time point after the second pixel voltage is outputted, a pixel electrode voltage of the second pixel is adjusted in order to lower the transmittance of the second pixel. The second predetermined time point follows the first predetermined time point. When the first pixel voltage substantially equals the second pixel voltage, an integrated value of the transmittance of the first pixel over time in a lighting period of the backlight module is a first light intensity value and an integrated value of the transmittance of the second pixel over the time in the lighting period of the backlight module is a second light intensity value. The difference between the first light intensity value and the second light intensity value is substantially smaller than 20% of the first light intensity value According to a second aspect of the present invention, a liquid crystal display is provided. The liquid crystal display includes a backlight module and a pixel array. The pixel array includes a first row of pixels and a second row of pixels. A first pixel in the first row of pixels receives a first pixel voltage to change a transmittance of the first pixel. A second pixel in the second row of pixels receives a second pixel voltage to change a transmittance of the second pixel. The first row of pixels and the second row of pixels are sequentially driven. At a first predetermined time point after the first pixel receives the first pixel voltage, a pixel electrode voltage of the first pixel is adjusted in order to lower the transmittance of the first pixel. At a second predetermined time point after the second pixel receives the second pixel voltage, a pixel electrode voltage of the second pixel is adjusted in order to lower the transmittance of the second pixel. The second predetermined time point follows the first predetermined time point. When the first pixel voltage substantially equals the second pixel voltage, an integrated value of the transmittance of the first pixel over time in a lighting period of the backlight module is a first light intensity value, and an integrated value of the transmittance of the second pixel over the time in the lighting period of the backlight module is a second light intensity value. The difference between the first light intensity value and the second light intensity value is substantially smaller than 20% of the first light intensity value.

The invention will become apparent from the following detailed description of the preferred but non-limiting embodiments. The following description is made with reference to the accompanying drawings.

DETAILED DESCRIPTION OF THE INVENTION

The liquid crystal display of the invention almost equalizes the light intensity values of different pixels by adjusting the time points of turning on and off the backlight module so as to improve the phenomenon of the non-uniform luminance of the liquid crystal display panel and to reduce the shifting of the gamma curve.

First Embodiment

Figure 1A:
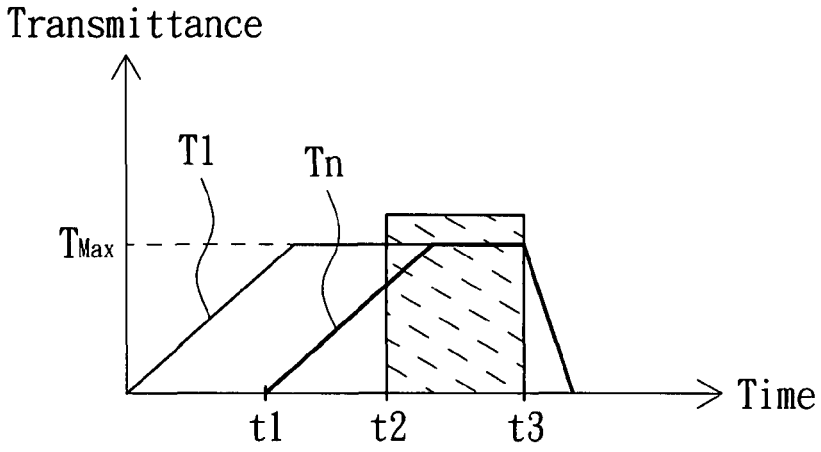
FIG. 1A(RELATED ART)
FIG. 1A shows a relationship between time and a transmittance of a conventional liquid crystal display panel.
Figure 1B:
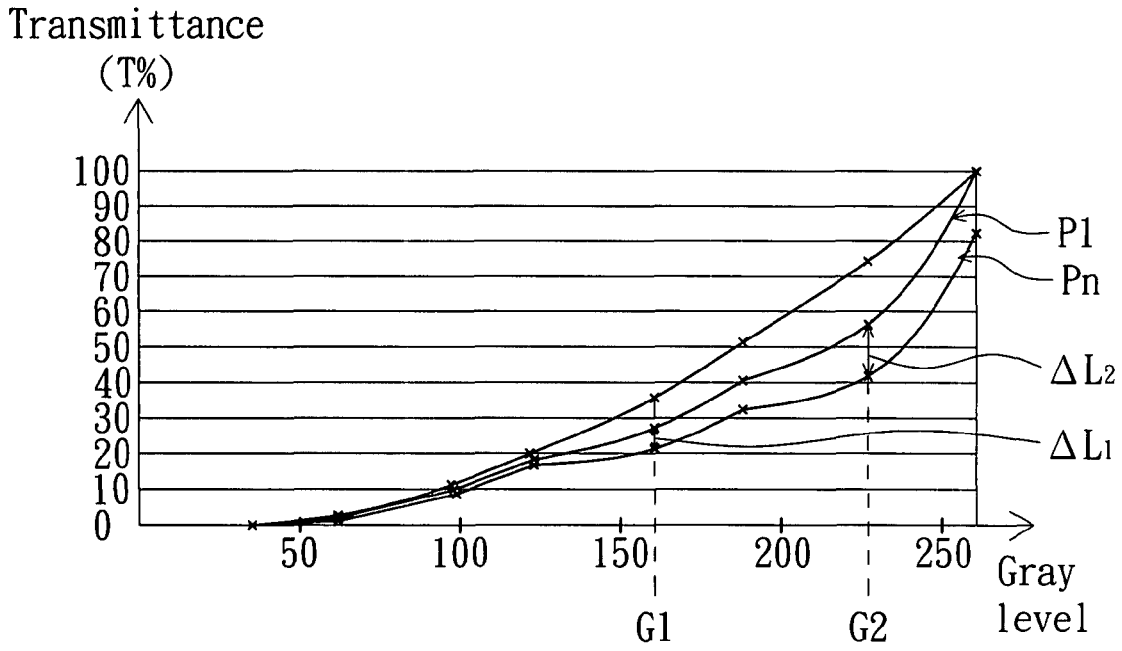
FIG. 1B(RELATED ART)
FIG. 1B shows gamma curves of the liquid crystal display panel of FIG. 1A.
Figure 2:
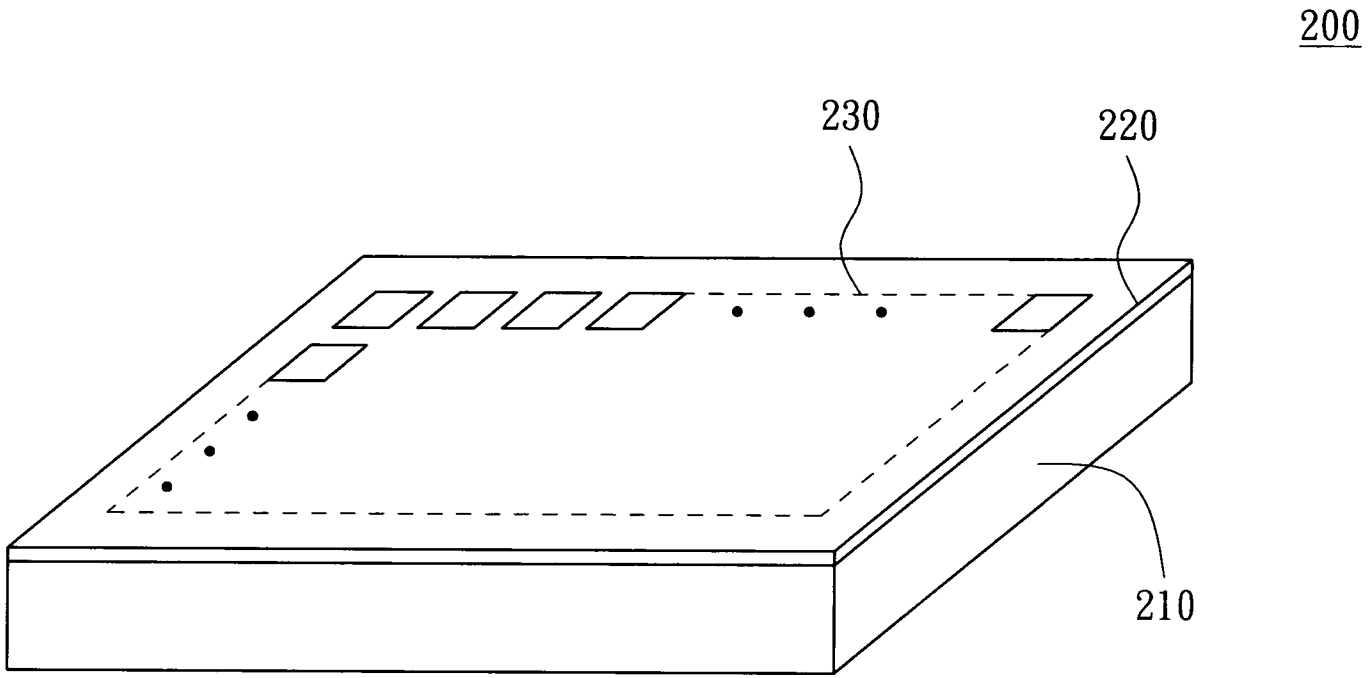
FIG. 2 is a schematic illustration showing a liquid crystal display according to a first embodiment of the invention.
Figure 3:
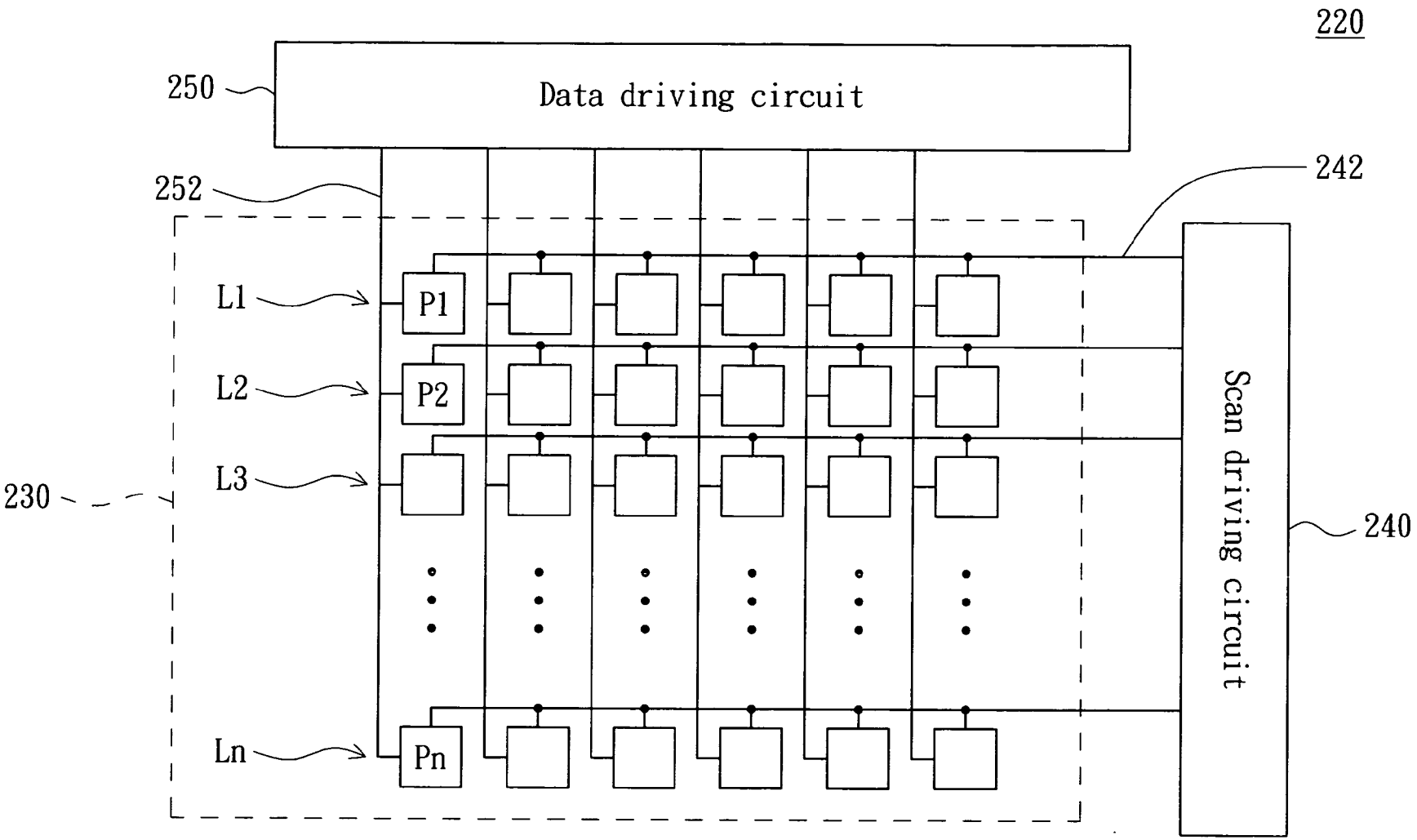
FIG. 3 is a schematic illustration showing a pixel array according to the first embodiment of the invention.

FIG. 2 is a schematic illustration showing a liquid crystal display 200 according to a first embodiment of the invention. FIG. 3 is a schematic illustration showing a pixel array according to the first embodiment of the invention. Referring to FIGS. 2 and 3, the liquid crystal display 200 includes a backlight module 210 and a liquid crystal display panel 220 having a pixel array 230. The pixel array 230 includes many rows L1 to Ln of pixels, which are respectively coupled to a scan driving circuit 240 through scan lines 242 and respectively coupled to a data driving circuit 250 through data lines 252. The scan driving circuit 240 provides a scan voltage to these pixels, while the data driving circuit 250 provides a pixel voltage to the corresponding pixels in order to change the transmittances of these pixels.

Figure 4:
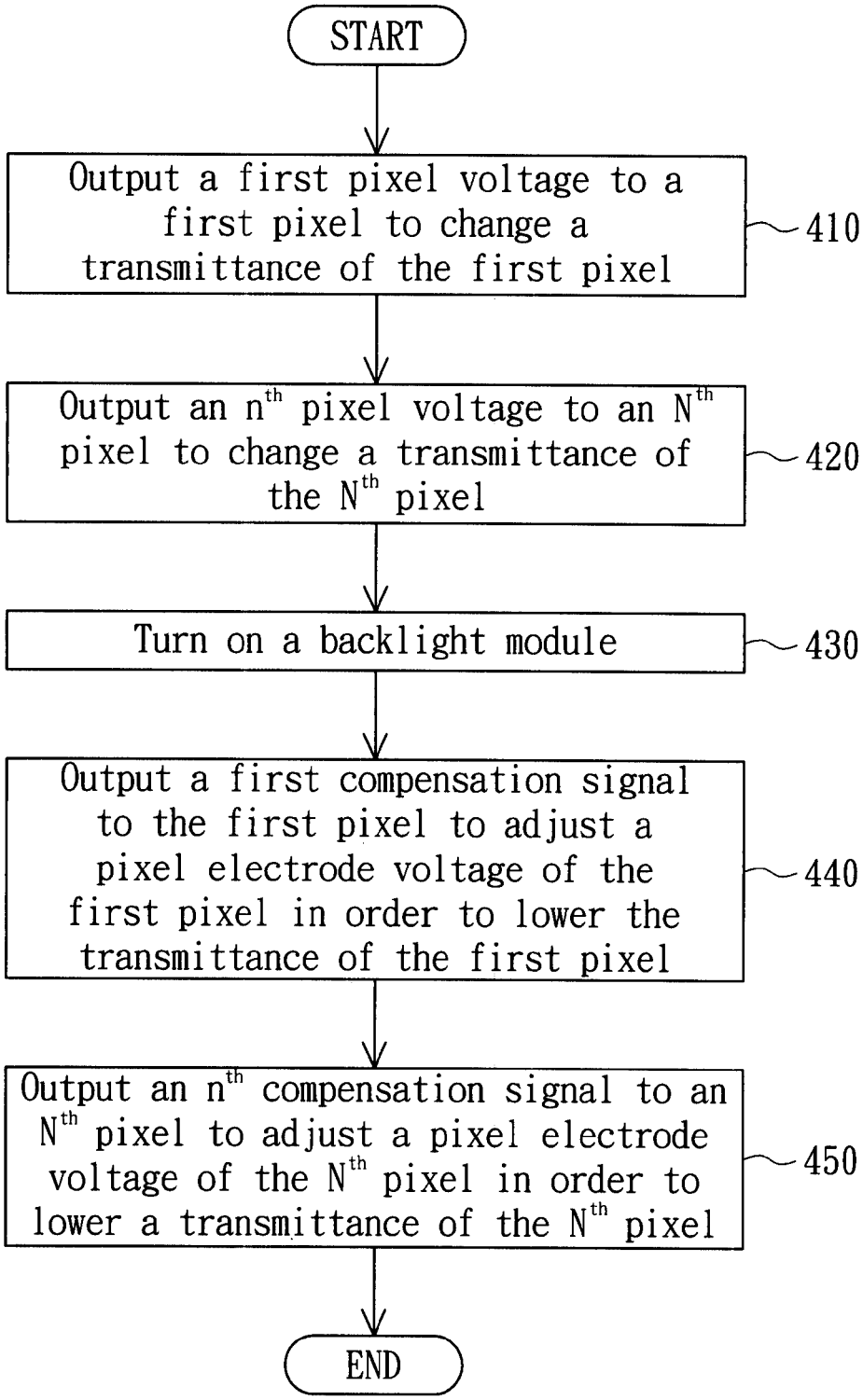
FIG. 4 is a flow chart showing a driving method of the liquid crystal display according to the first embodiment of the invention.
Figure 5A:
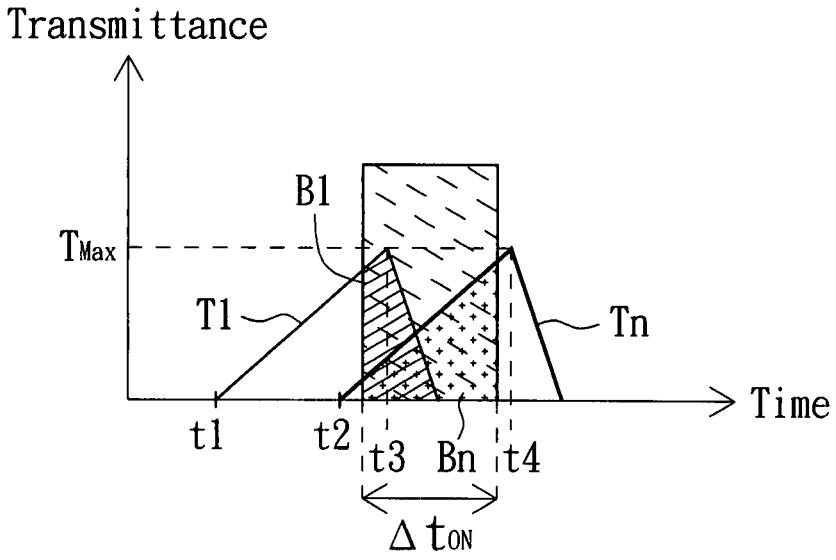
FIG. 5A shows a first example of a relationship between time and a transmittance of a pixel when the driving method of the liquid crystal display according to the first embodiment of the invention is applied.

FIG. 4 is a flow chart showing a driving method of the liquid crystal display according to the first embodiment of the invention. FIG. 5A shows a first example of a relationship between time and a transmittance of a pixel when the driving method of the liquid crystal display according to the first embodiment of the invention is applied. Referring to FIGS. 4 and 5A, step 410 is performed at a first time point t1 to enable a first pixel P1 in the first row of pixels $L_1$ to receive a first pixel voltage outputted from the data driving circuit 250 in order to change the transmittance T1 of the first pixel. Next, step 420 is performed at a second time point t2 to enable an $N^{th}$ pixel Pn in the $N^{th}$ row of pixels Ln to receive an $n^{th}$ pixel voltage outputted from the data driving circuit 250 in order to change the transmittance Tn of the $N^{th}$ pixel. Then, step 430 is performed to turn on the backlight module 210. Next, step 440 is performed at a first predetermined time point t3 after the data driving circuit 250 outputs the first pixel voltage, and the data driving circuit 250 outputs a first compensation signal to the first pixel P1 to adjust a pixel electrode voltage of the first pixel in order to lower the transmittance T1 of the first pixel. Then, step 450 is performed at an $n^{th}$ predetermined time point t4 after the data driving circuit 250 outputs the $n^{th}$ pixel voltage, and the data driving circuit 250 outputs an $n^{th}$ compensation signal to the $N^{th}$ pixel Pn to adjust a pixel electrode voltage of the $N^{th}$ pixel in order to lower the transmittance Tn of the $N^{th}$ pixel.

It is assumed that the first pixel voltage received by the first pixel is substantially equal to the $n^{th}$ pixel voltage received by the $N^{th}$ pixel in the first embodiment. Under this condition, the maximum transmittance T1 of the first pixel substantially equals the maximum transmittance Tn of the $N^{th}$ pixel, such as the maximum transmittance $T_{Max}$ shown in FIG. 5A. In a lighting period $\Delta t_{ON}$ of the backlight module 210, an integrated value of the transmittance T1 of the first pixel over the time is a first light intensity value B1, and an integrated value of the transmittance Tn of the $N^{th}$ pixel over the time is an $N^{th}$ light intensity value Bn. Preferably, a difference between the first light intensity value B1 and the $N^{th}$ light intensity value Bn is smaller than 20% of the first light intensity value B1.

More preferably, the first light intensity value B1 substantially equals the $N^{th}$ light intensity value Bn.

Preferably, the backlight module 210 is turned on after the transmittance T1 of the first pixel is greater than zero to enter a lighting state, and the backlight module 210 is turned off before the transmittance Tn of the $N^{th}$ pixel is substantially equal to zero to enter a darkening state. More preferably, the backlight module 210 is turned on after the transmittance T1 of the first pixel is greater than zero and before the $N^{th}$ pixel has the maximum transmittance to enter the lighting state; and the backlight module 210 is turned off after the first pixel has the maximum transmittance and before the transmittance of the $N^{th}$ pixel is substantially equal to zero to enter the darkening state.

Figure 5B:
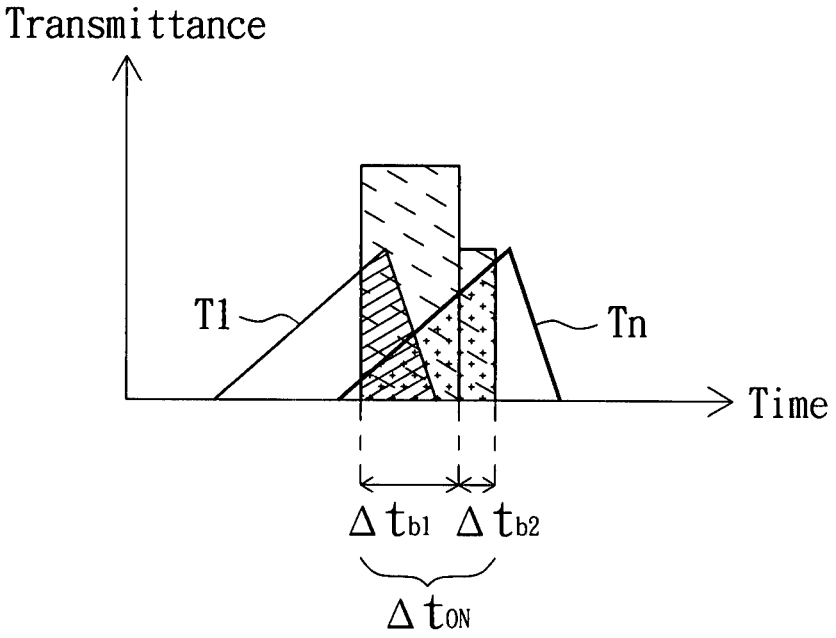
FIGS. 5B and 5C show second and third examples of relationships between the time and the transmittance of the pixel when the driving method of the liquid crystal display according to the first embodiment of the invention is applied.
Figure 5C:
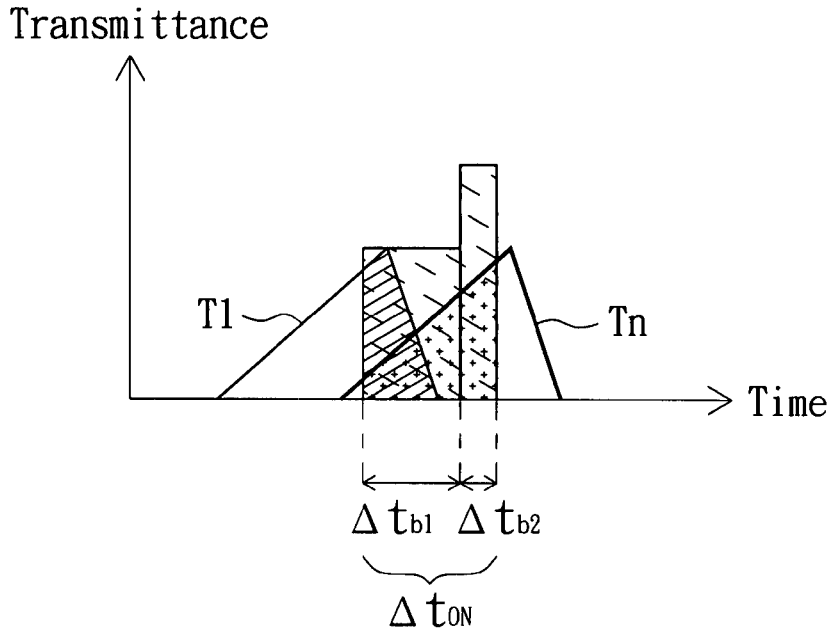

FIGS. 5B and 5C show second and third examples of relationships between the time and the transmittance of the pixel when the driving method of the liquid crystal display according to the first embodiment of the invention is applied. As shown in FIGS. 5B to 5C, what is different from the example of FIG. 5A is that the lighting period $\Delta t_{ON}$ of backlight module 210 includes a first sub-period $\Delta t_{b1}$ and a second sub-period $\Delta t_{b2}$. The backlight module 210 keeps a first luminance in the first sub-period $\Delta t_{b1}$, and keeps a second luminance in the second sub-period $\Delta t_{b2}$. The first luminance may be unequal to the second luminance. As shown in FIG. 5B, the first luminance is greater than the second luminance. As shown in FIG. 5C, the first luminance may also be smaller than the second luminance.

Figure 5D:
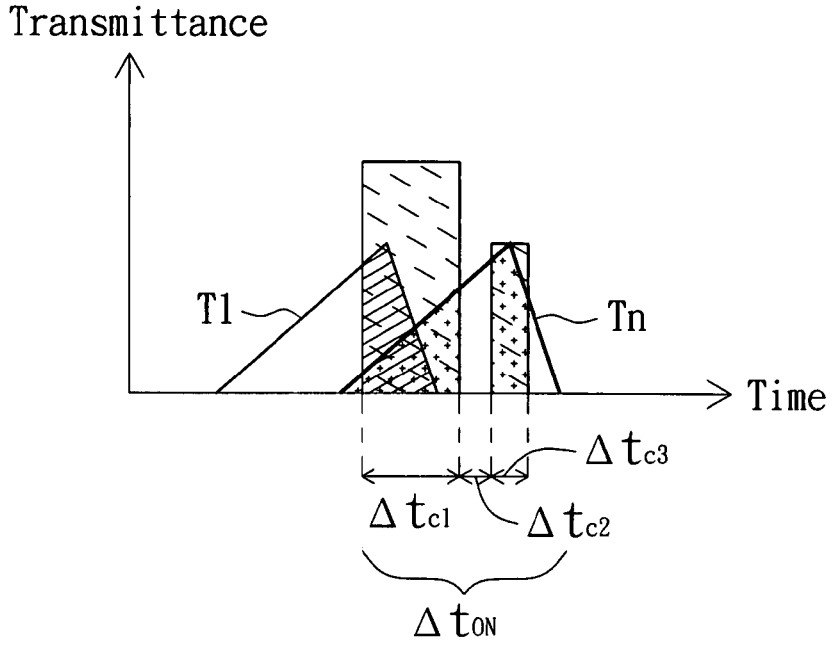
FIGS. 5D and 5E show fourth and fifth examples of relationships between the time and the transmittance of the pixel when the driving method of the liquid crystal display according to the first embodiment of the invention is applied.
Figure 5E:
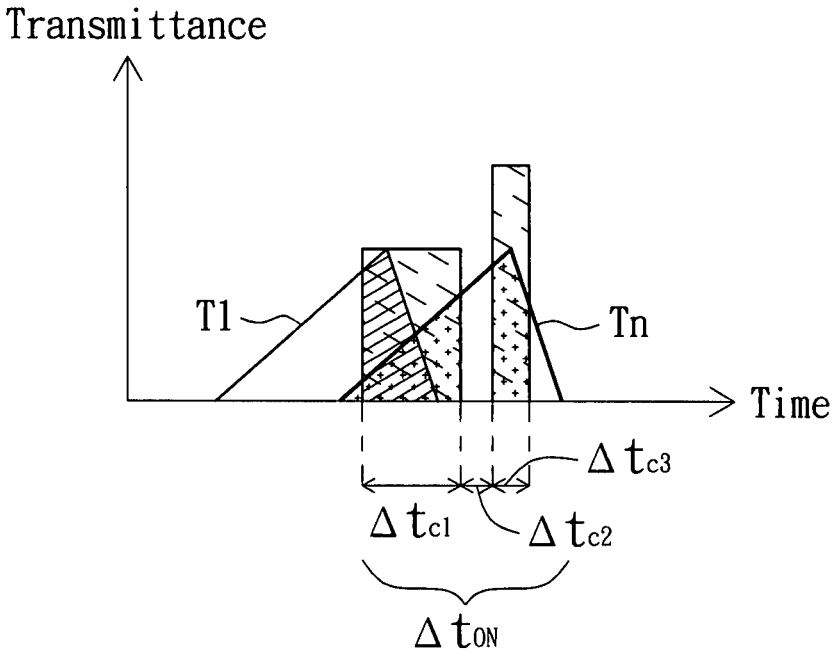

FIGS. 5D and 5E show fourth and fifth examples of relationships between the time and the transmittance of the pixel when the driving method of the liquid crystal display according to the first embodiment of the invention is applied. As shown in FIGS. 5D to 5E, what is different from the example of FIG. 5B is that the lighting period $\Delta t_{ON}$ of backlight module 210 includes a first sub-period $\Delta t_{c1}$, a second sub-period $\Delta t_{c2}$ and a third sub-period $\Delta t_{c3}$. The backlight module 210 keeps a first luminance in the first sub-period $\Delta t_{c1}$, keeps a second luminance in the second sub-period $\Delta t_{c2}$, and keeps a third luminance in the third sub-period $\Delta t_{c3}$. The first luminance is unequal to the third luminance and the second luminance almost equals zero. As shown in FIG. 5D, the first luminance is greater than the third luminance. As shown in FIG. 5E, the first luminance may also be smaller than the third luminance.

Figure 5F:
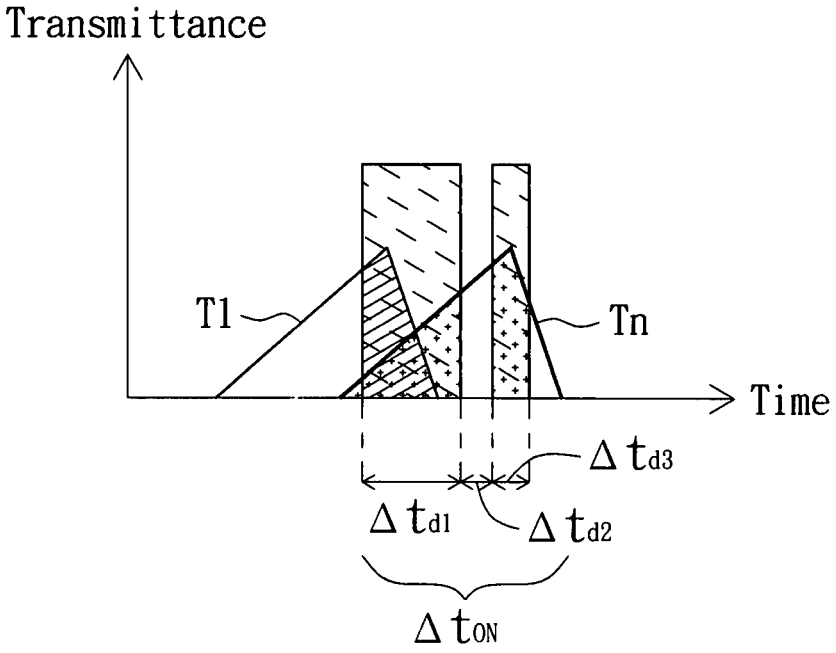
FIG. 5F shows a sixth example of a relationship between the time and the transmittance of the pixel when the driving method of the liquid crystal display according to the first embodiment of the invention is applied.

FIG. 5F shows a sixth example of a relationship between the time and the transmittance of the pixel when the driving method of the liquid crystal display according to the first embodiment of the invention is applied. As shown in FIG. 5F, what is the same as the example of FIG. 5D is that the lighting period $\Delta t_{ON}$ of backlight module 210 includes a first sub-period $\Delta t_{d1}$, in which the backlight module 210 keeps a first luminance, a second sub-period $\Delta t_{d2}$, in which the backlight module 210 keeps a second luminance and a third sub-period $\Delta t_{d3}$, in which the backlight module 210 keeps a third luminance. However, what is different from the example of FIG. 5D is that the first luminance substantially equals the third luminance.

Figure 6:
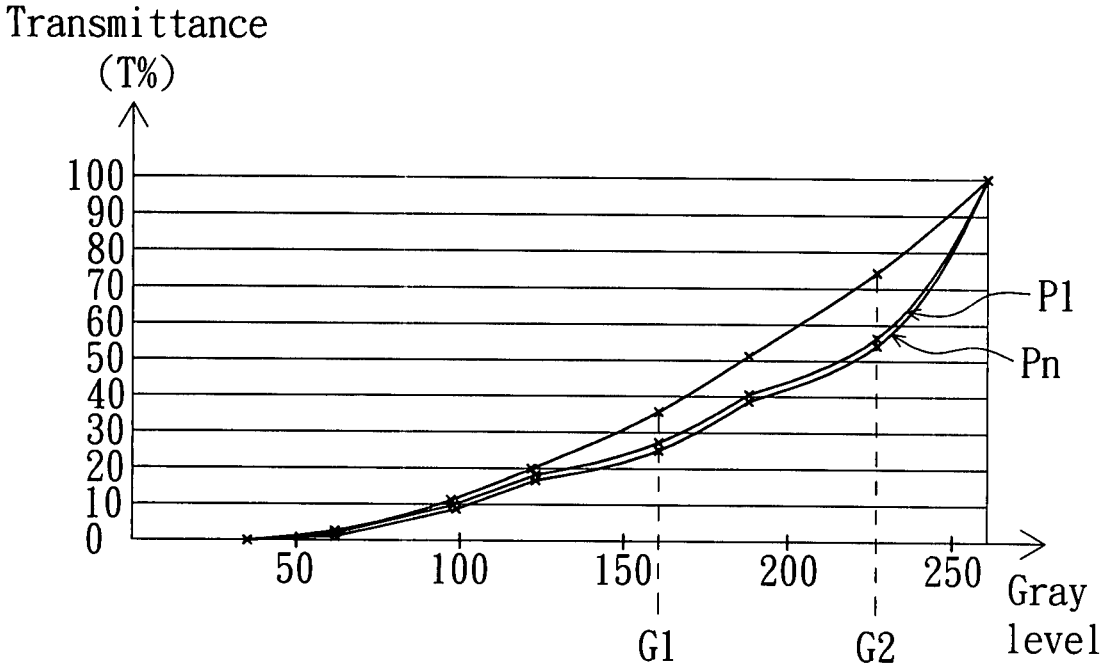
FIG. 6 shows gamma curves of the liquid crystal display according to the first embodiment of the invention.

FIG. 6 shows gamma curves of the liquid crystal display according to the first embodiment of the invention. Taking the adjusting method of the backlight module of FIG. 5A as an example, when the liquid crystal display 200 adjusts the time points of turning on/off the backlight module 210, the transmittance of the first pixel P1 is almost equal to the transmittance of the $N^{th}$ pixel Pn at a first reference gray level G1; and the transmittance of the first pixel P1 is almost equal to the transmittance of the $N^{th}$ pixel Pn at a second reference gray level G2. Thus, the driving method of the liquid crystal display according to this embodiment can effectively reduce the shifting of the gamma curve comparing to the conventional liquid crystal display.

Second Embodiment

Figure 7A:
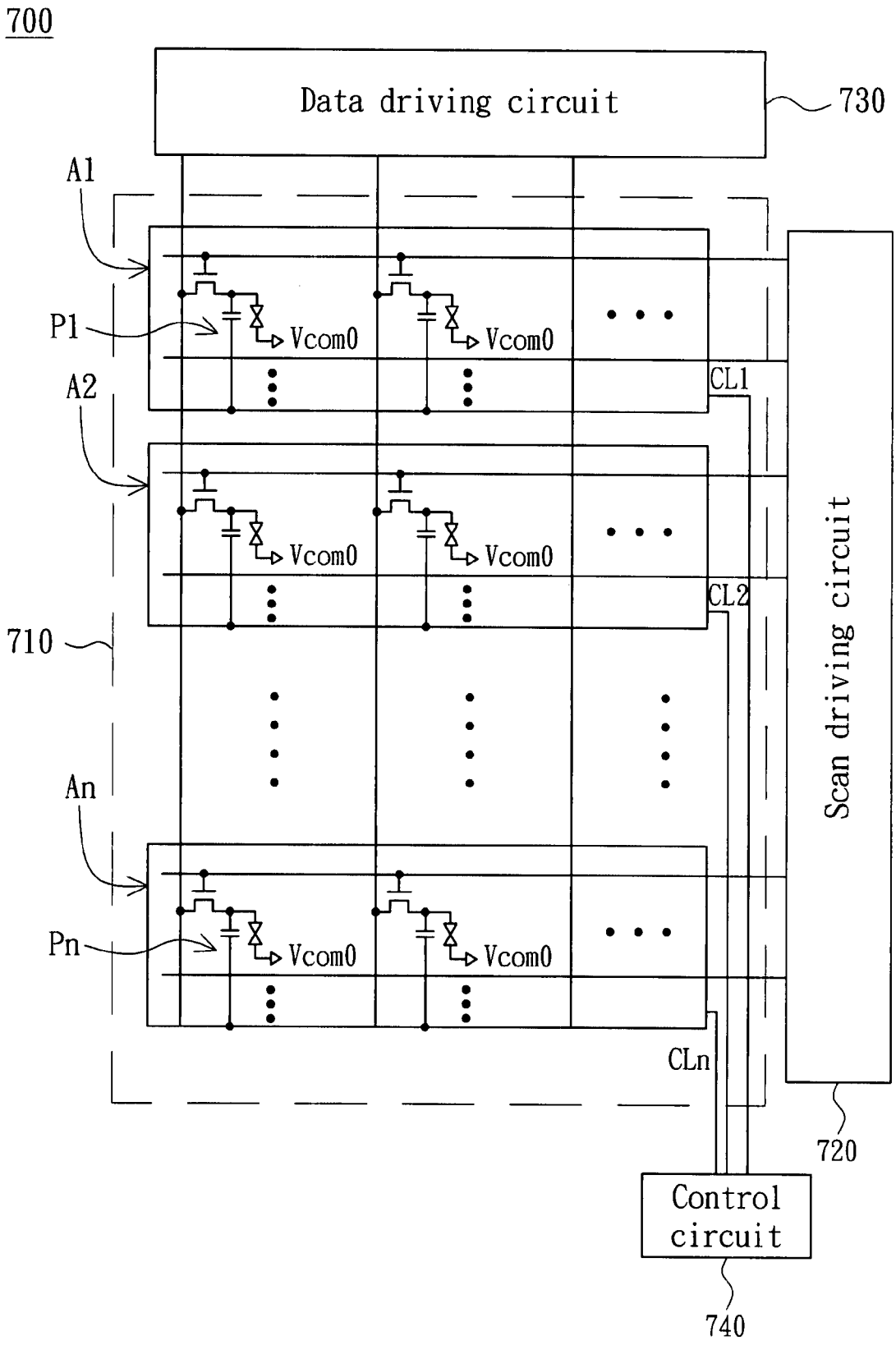
FIG. 7A is a schematic illustration showing a liquid crystal display panel according to a second embodiment of the invention.

FIG. 7A is a schematic illustration showing a liquid crystal display panel according to a second embodiment of the invention. As shown in FIG. 7A, what is different from the first embodiment is that a display area of a pixel array 710 in a liquid crystal display panel 700 is divided into multiple sub-display areas A1 to An. Each sub-display area includes multiple rows of pixels, which are respectively coupled to a scan driving circuit 720 and a data driving circuit 730. In addition, first ends of storage capacitors of the rows of pixels in the first sub-display area A1 are coupled to a first common electrode line CL1, first ends of storage capacitors of the rows of pixels in the second sub-display area A2 are coupled to a second common electrode line CL2, and first ends of storage capacitors of the rows of pixels in the $N^{th}$ sub-display area An are coupled to an $N^{th}$ common electrode line CLn. A control circuit 740 is provided to adjust voltages of common electrode lines $V_{com1}$ to $V_{comN}$.

Figure 7B:
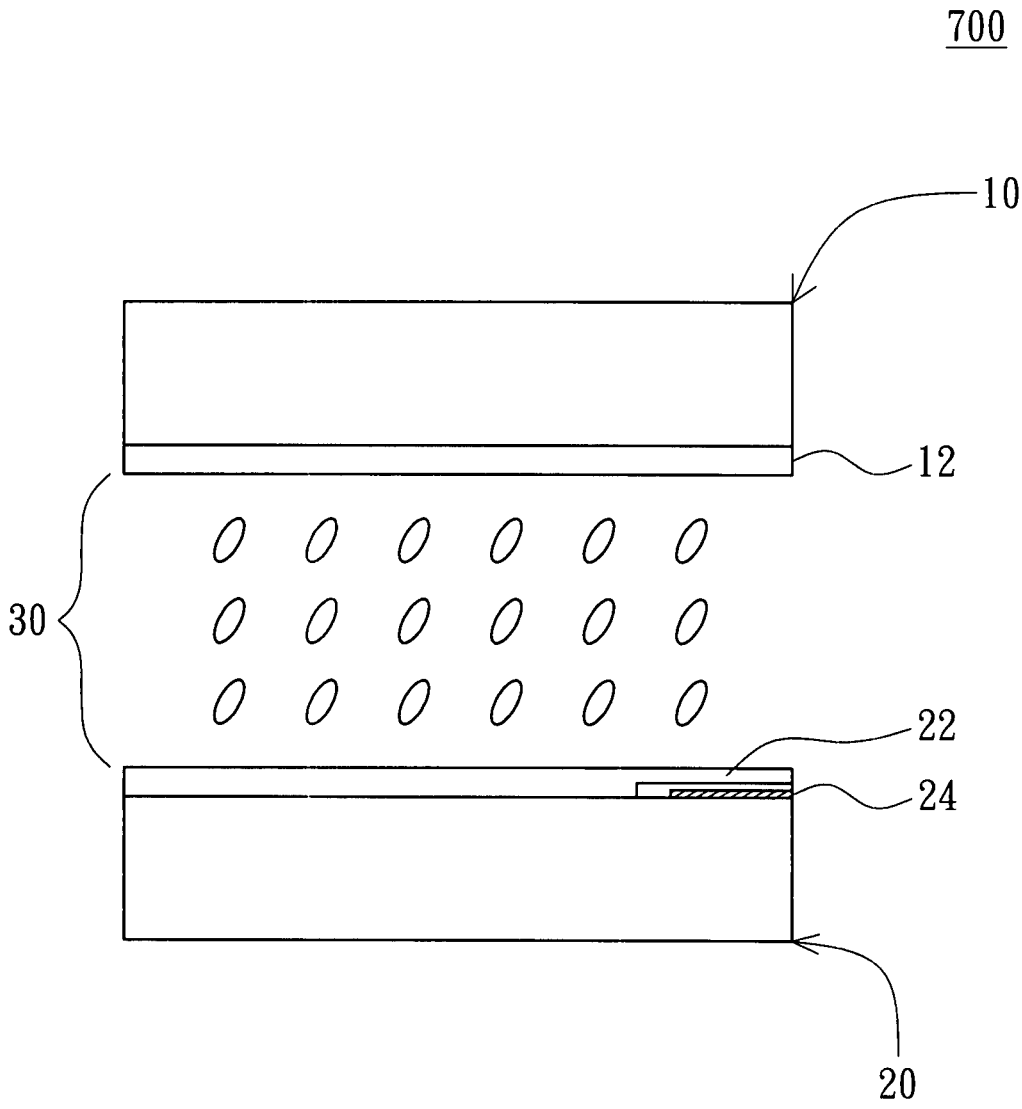
FIG. 7B is a cross-sectional view showing a portion of the liquid crystal display panel according to the second embodiment of the invention.

FIG. 7B is a cross-sectional view showing a portion of the liquid crystal display panel according to the second embodiment of the invention. Referring to FIG. 7B, the liquid crystal display panel 700 includes an upper substrate 10, a thin film transistor substrate 20 and a liquid crystal layer 30. The upper substrate 10 includes a reference electrode 12, and the thin film transistor substrate 20 includes a pixel electrode 22 and a common electrode 24. The liquid crystal layer 30 is disposed between the upper substrate 10 and the thin film transistor substrate 20. The reference electrode 12, the pixel electrode 22 and the liquid crystal layer 30 of the upper substrate are equivalent to a pixel capacitor, and the storage capacitor is disposed between the pixel electrode 22 and the common electrode 24. The pixel electrode 22 is coupled to the common electrode 24, and the common electrode 24 is coupled to the control circuit 740 through the first common electrode line CL1. When the voltage $V_{com1}$ of the first common electrode line CL1 outputted from the control circuit 740 changes, the change of the voltage $V_{com1}$ is coupled to the pixel electrode 22 through the storage capacitor so that the voltage of the corresponding pixel electrode 22 correspondingly changes in order to change the transmittance of the pixel.

Figure 8:
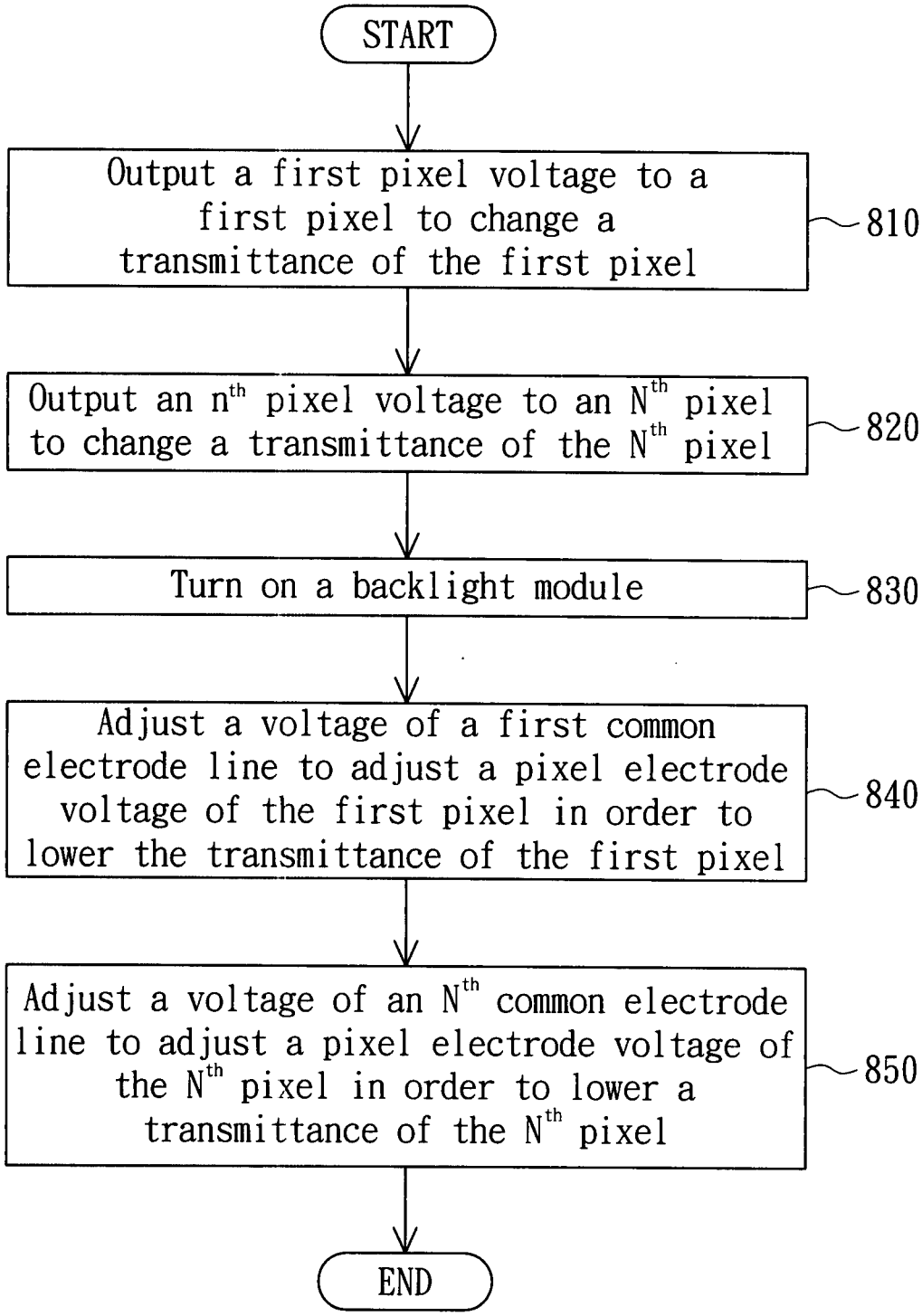
FIG. 8 is a flow chart showing a driving method according to the second embodiment of the invention.
Figure 9A:
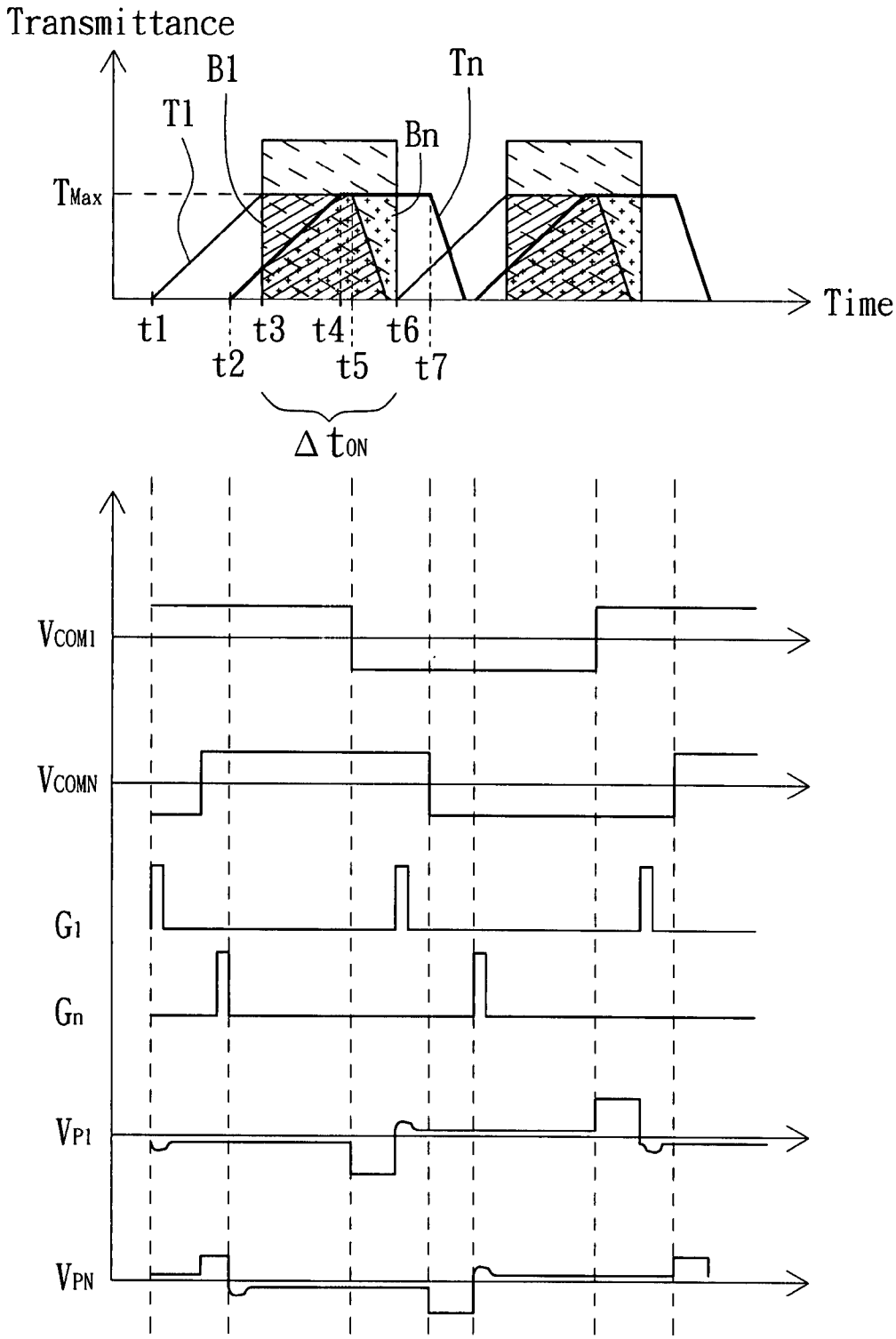
FIG. 9A shows a first example of a relationship between time and a transmittance of a pixel when the driving method of the liquid crystal display according to the second embodiment of the invention is applied.

Next, illustrations will be made to explain how to effectively solve the non-uniform luminance of the panel, according to the second embodiment of the invention, by taking the first pixel and the $N^{th}$ pixel as an example, and a method is further provided to enhance the luminance effectiveness of the liquid crystal display panel. The first pixel P1 is located in the first sub-display area A1 and coupled to a first scan line G1, and the $N^{th}$ pixel Pn is located in the $N^{th}$ sub-display area An and coupled to an $N^{th}$ scan line Gn. FIG. 8 is a flow chart showing a driving method according to the second embodiment of the invention. FIG. 9A shows a first example of a relationship between time and a transmittance of a pixel when the driving method of the liquid crystal display according to the second embodiment of the invention is applied. Referring to FIGS. 8 and 9A, step 810 is first performed at a first time point t1 so that the first scan line G1 is enabled to turn on the thin film transistor of the first pixel P1. Next, the turned-on first pixel P1 receives the first pixel voltage to change the transmittance T1 of the first pixel P1. Thereafter, the scan lines G2 to Gn−1 are sequentially enabled. Then, step 820 is performed at a second time point t2 so that the $N^{th}$ scan line Gn is enabled to turn on the thin film transistor of the $N^{th}$ pixel. Next, the turned-on $N^{th}$ pixel receives the $n^{th}$ pixel voltage to change the transmittance Tn of the $N^{th}$ pixel. Then, step 830 is performed to turn on a backlight module. At a third time point t3, the first pixel has reached the maximum transmittance $T_{Max}$, that is, the response of the liquid crystal molecules in the first pixel has been completed. At a fourth time point t4, the $N^{th}$ pixel has reached the maximum transmittance $T_{Max}$, that is, the response of the liquid crystal molecules in the $N^{th}$ pixel has been completed. Thereafter, step 840 is performed at a first predetermined time point t5 after the data driving circuit 730 outputs the first pixel voltage to adjust the voltage $V_{com1}$ of the first common electrode line CL1 through the control circuit 740 and to adjust the pixel electrode voltage $V_{p1}$ of the first pixel P1 in order to lower the transmittance T1 of the first pixel. After time point t6, the thin film transistor of the first pixel P1 is again turned on to receive a next pixel voltage so that the transmittance of the first pixel P1 changes again. Thereafter, the control circuit 740 sequentially adjusts the voltages of the other common electrode lines so as to adjust the pixel electrode voltages of the corresponding pixels and thus to lower the transmittances of the corresponding pixels. Then, step 850 is performed at a second predetermined time point t7 after the data driving circuit 730 outputs the $N^{th}$ pixel voltage so as to adjust the voltage $V_{comN}$ of the $N^{th}$ common electrode line CLn by the control circuit 740, and to adjust the pixel electrode voltage $V_{pN}$ of the $N^{th}$ pixel to lower the transmittance TN of the $N^{th}$ pixel. The time points of turning on/off the backlight module of this embodiment may be selected according to the rule the same as that for the backlight module of the first embodiment, so detailed descriptions thereof will be omitted.

Similar to the first embodiment, it is assumed that the first pixel voltage received by the first pixel substantially equals the second pixel voltage received by the $N^{th}$ pixel in the second embodiment. Under this condition, the maximum transmittance T1 of the first pixel substantially equals the maximum transmittance Tn of the $N^{th}$ pixel, as shown in the maximum transmittance $T_{Max}$ of FIG. 9A. In the lighting period $\Delta t_{ON}$ of backlight module 210, the integrated value of the transmittance T1 of the first pixel over the time is the first light intensity value B1, and the integrated value of the transmittance Tn of the $N^{th}$ pixel over the time is the $N^{th}$ light intensity value Bn. Preferably, the difference between the first light intensity value B1 and the $N^{th}$ light intensity value Bn is smaller than 20% of the first light intensity value B1. More preferably, the first light intensity value B1 substantially equals the $N^{th}$ light intensity value Bn.

Figure 9B:
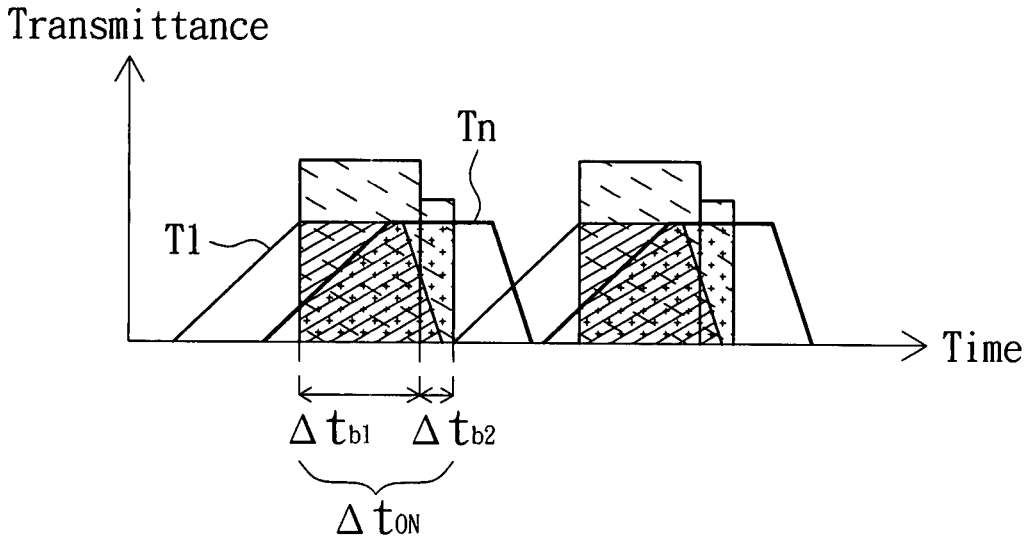
FIGS. 9B and 9C show second and third examples of relationships between the time and the transmittance of the pixel when the driving method of the liquid crystal display according to the second embodiment of the invention is applied.
Figure 9C:
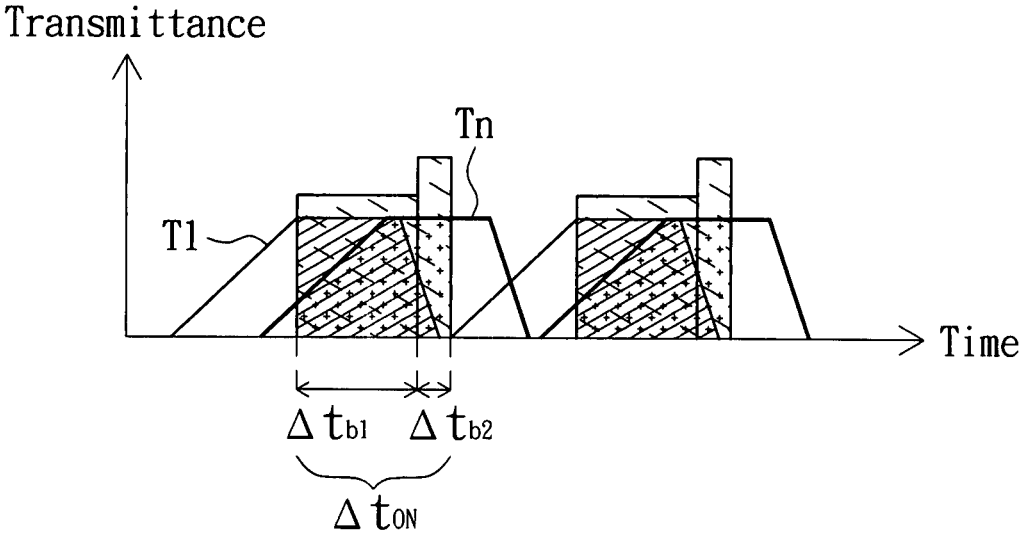

FIGS. 9B and 9C show second and third examples of relationships between the time and the transmittance of the pixel when the driving method of the liquid crystal display according to the second embodiment of the invention is applied. As shown in FIGS. 9B to 9C, what is different from the example of FIG. 9A is that the lighting period $\Delta t_{ON}$ of backlight module 210 includes a first sub-period $\Delta t_{b1}$ and a second sub-period $\Delta t_{b2}$. The backlight module keeps the first luminance in the first sub-period $\Delta t_{b1}$, and keeps the second luminance in the second sub-period $\Delta t_{b2}$. The first luminance is unequal to the second luminance. As shown in FIG. 9B, the first luminance is greater than the second luminance. As shown in FIG. 9C, the first luminance may also be smaller than the second luminance.

Figure 9D:
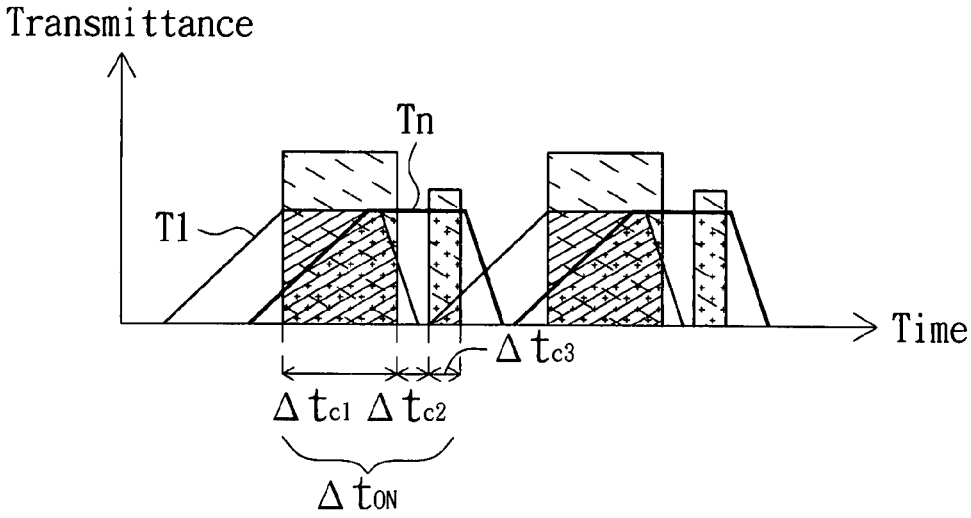
FIGS. 9D and 9E show fourth and fifth examples of relationships between the time and the transmittance of the pixel when the driving method of the liquid crystal display according to the second embodiment of the invention is applied.
Figure 9E:
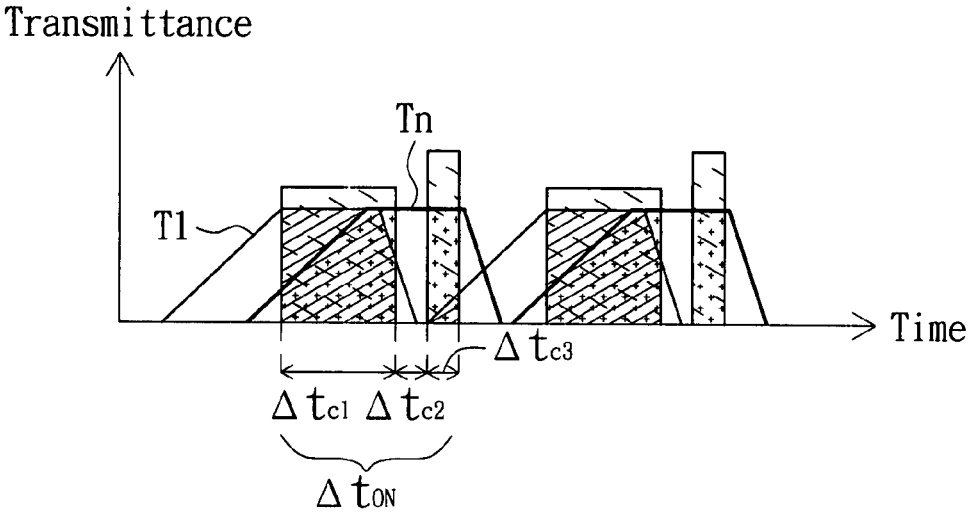

FIGS. 9D and 9E show fourth and fifth examples of relationships between the time and the transmittance of the pixel when the driving method of the liquid crystal display according to the second embodiment of the invention is applied. As shown in FIGS. 9D to 9E, what is different from the example of FIG. 9B is that the lighting period $\Delta t_{ON}$ of backlight module 210 includes a first sub-period $\Delta t_{c1}$, a second sub-period $\Delta t_{c2}$ and a third sub-period $\Delta t_{c3}$. The backlight module keeps a first luminance in the first sub-period $\Delta t_{c1}$, keeps a second luminance in the second sub-period $\Delta t_{c2}$, and keeps a third luminance in the third sub-period $\Delta t_{c3}$. The first luminance is unequal to the third luminance, and the second luminance almost approaches zero. As shown in FIG. 9D, the first luminance is greater than the third luminance. As shown in FIG. 9E, the first luminance may also be smaller than the third luminance.

Figure 9F:
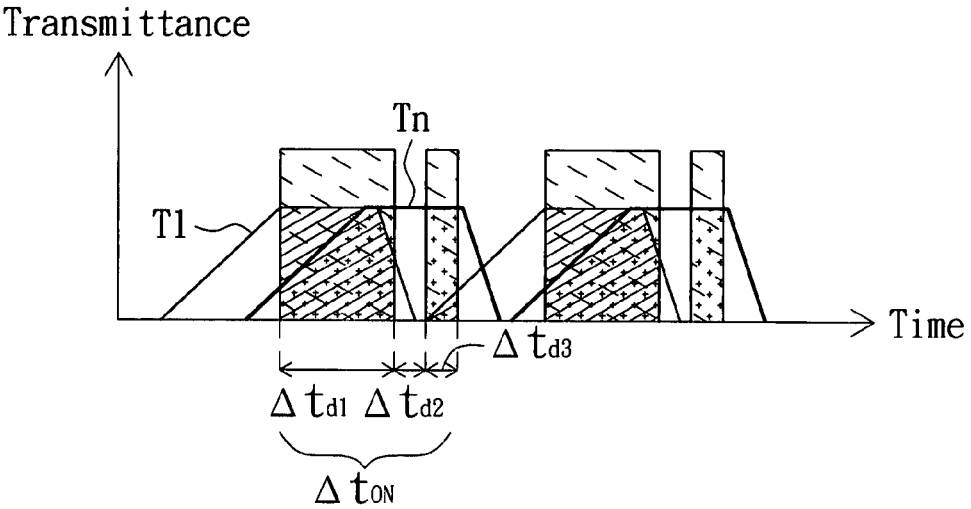
FIG. 9F shows a sixth example of a relationship between the time and the transmittance of the pixel when the driving method of the liquid crystal display according to the second embodiment of the invention is applied.

FIG. 9F shows a sixth example of a relationship between the time and the transmittance of the pixel when the driving method of the liquid crystal display according to the second embodiment of the invention is applied. Referring to FIG. 9F, what is the same as the example of FIG. 9D is that the lighting period $\Delta t_{ON}$ of backlight module 210 includes a first sub-period $\Delta t_{d1}$, in which the backlight module keeps a first luminance, a second sub-period $\Delta t_{d2}$, in which the backlight module keeps a second luminance, and a third sub-period $\Delta t_{d3}$, in which the backlight module keeps a third luminance. However, what is different form the example of FIG. 9D is that the first luminance substantially equals the third luminance.

Compared FIG. 9A with FIG. 5A, the following conditions may be obtained. In FIG. 5A, before a next frame display signal is driven, the scan lines cannot be enabled to write the next frame display signal until the compensation signals of all pixels are sequentially written. In FIG. 9A, the first pixel P1 of this embodiment does not have to wait for the finished signal compensating operations of the pixels in other areas (e.g., the $N^{th}$ pixel Pn), and the first scan line G1 can be enabled to drive the first pixel P1 to receive the next pixel voltage. Consequently, the next pixel voltage signal could be provided while the signal compensating operations are performed, so that the time of keeping the maximum transmittance of the pixels can be lengthened and the light intensity value of each pixel can be enhanced to avoid the luminance loss of the liquid crystal display panel. Similarly, the driving method of the liquid crystal display in FIGS. 9B to 9D may also avoid the luminance loss of the liquid crystal display panel, and detailed description thereof will be omitted.

The conventional color sequence liquid crystal display has the liquid crystal molecules with the shorter response time (about 5.56 ms) so that not both of the liquid crystal molecules in the upper and lower rows of pixels of the liquid crystal display panel response completely when the backlight module are turned on, the liquid crystal display panel has the phenomenon of the non-uniform luminance, and shifting of the gamma curve occurs. In the liquid crystal displays according to the embodiment of the invention, adjusting the time points of turning on and off the backlight module can substantially equalize the integrated values of the transmittances of the pixels over the time during the period when the backlight module lights up. So, the problems of the non-uniform luminance of the liquid crystal display panel and the shifting of the gamma curve can be effectively solved. In addition, adjusting the voltage of the common electrode line can lengthen the response time of the liquid crystal molecules so that the luminance of all the pixels can be further increased to avoid the luminance loss of the liquid crystal display.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a liquid crystal display, the liquid crystal display comprising a back light module and a pixel array having a first row of pixels and a second row of pixels, the method comprising:

(a) turning on a thin film transistor of a first pixel in the first row of pixels by a first scan signal and outputting a first pixel voltage to the first pixel in the first row of pixels to change a transmittance of the first pixel, and then outputting a second pixel voltage to a second pixel in the second row of pixels to change a transmittance of the second pixel;

(b) turning on the backlight module;

(c) adjusting a pixel electrode voltage of the first pixel at a first predetermined time point after outputting the first pixel voltage and before turning on the thin film transistor of the first pixel by a second scan signal next to and occurring immediately after the first scan signal; and (d) adjusting a pixel electrode voltage of the second pixel at a second predetermined time point after outputting the second pixel voltage, wherein the second predetermined time point is subsequent to the first predetermined time point, wherein when the first pixel voltage substantially equals the second pixel voltage, an integration of the transmittance of the first pixel over time in a lighting period of the backlight module is a first light intensity value and an integration of the transmittance of the second pixel over the time in the lighting period of the backlight module is a second light intensity value, and the difference between the first light intensity value and the second light intensity value is substantially smaller than 20% of the first light intensity value.

2. The method according to claim 1, wherein the second light intensity value is substantially equal to the first light intensity value.

3. The method according to claim 1, wherein a first compensation signal is outputted to the first pixel to adjust the pixel electrode voltage of the first pixel in step (c), and a second compensation signal is outputted to the second pixel to adjust the pixel electrode voltage of the second pixel in step (d).

4. The method according to claim 1, wherein the first pixel is coupled to a first common electrode line, the second pixel is coupled to a second common electrode line, a voltage of the first common electrode line is adjusted to directly adjust the pixel electrode voltage of the first pixel in step (c), and a voltage of the second common electrode line is adjusted to directly adjust the pixel electrode voltage of the second pixel in step (d).

5. The method according to claim 1, wherein the backlight module is turned on after the transmittance of the first pixel is greater than zero to enter a lighting state, the backlight module is turned off before the transmittance of the second pixel is substantially equal to zero to enter a darkening state, and the backlight module keeps a first luminance in the lighting period of the backlight module.

6. The method according to claim 5, wherein the backlight module is turned on after the transmittance of the first pixel is greater than zero and before the second pixel has a maximum transmittance to enter the lighting state.

7. The method according to claim 5, wherein the backlight module is turned on after the second pixel has a maximum transmittance to enter the lighting state.

8. The method according to claim 5, wherein the backlight module is turned off after the first pixel has a maximum transmittance and before the transmittance of the second pixel reaches a minimum to enter the darkening state.

9. The method according to claim 1, wherein the lighting period of the backlight module comprises a first sub-period and a second sub-period, the backlight module keeps a first luminance in the first sub-period, and the backlight module keeps a second luminance in the second sub-period.

10. The method according to claim 9, wherein the first luminance is unequal to the second luminance.

11. The method according to claim 1, wherein the lighting period of the backlight module comprises a first sub-period, a second sub-period, and a third sub-period, the second sub-period is between the first sub-period and the third sub-period, the backlight module keeps a first luminance in the first sub-period, the backlight module keeps a second luminance in the second sub-period, the backlight module keeps a third luminance in the third sub-period, and the second luminance substantially equals zero.

12. The method according to claim 11, wherein the first luminance and the third luminance are different.

13. The method according to claim 11, wherein the first luminance is substantially equal to the third luminance.

14. The method according to claim 11, wherein the backlight module is turned on and off more than twice.

15. A liquid crystal display, comprising:

a backlight module; and a pixel array comprising:

a first row of pixels and a second row of pixels, a thin film transistor of a first pixel in the first row of pixels is turned on by a first scan signal to receive a first pixel voltage in order to change a transmittance of the first pixel, a second pixel of the second row of pixels receiving a second pixel voltage in order to change a transmittance of the second pixel, the first row of pixels and the second row of pixels being sequentially driven;

wherein a pixel electrode voltage of the first pixel is adjusted at a first predetermined time point after the first pixel receives the first pixel voltage and before the thin film transistor of the first pixel is turned on by a second scan signal next to and immediately following the first scan signal, a pixel electrode voltage of the second pixel is adjusted at a second predetermined time point after the second pixel receives the second pixel voltage, and the second predetermined time point follows the first predetermined time point; and wherein when the first pixel voltage substantially equals the second pixel voltage, an integrated value of the transmittance of the first pixel over time in the lighting period of the backlight module is a first light intensity value, an integrated value of the transmittance of the second pixel over the time in the lighting period of the backlight module is a second light intensity value, and the difference between the first light intensity value and the second light intensity value is substantially smaller than 20% of the first light intensity value.

16. The display according to claim 15, wherein the second light intensity value is substantially equal to the first light intensity value.

17. The display according to claim 15, wherein the first pixel is adapted to receive a first compensation signal to adjust the pixel electrode voltage of the first pixel, and the second pixel is adapted to receive a second compensation signal to adjust the pixel electrode voltage of the second pixel.

18. The display according to claim 15, wherein the first pixel is coupled to a first common electrode line, a voltage of the first common electrode line is adjusted to directly adjust the pixel electrode voltage of the first pixel, the second pixel is coupled to a second common electrode line, and a voltage of the second common electrode line is adjusted to directly adjust the pixel electrode voltage of the second pixel.

19. The display according to claim 15, wherein the backlight module is turned on after the transmittance of the first pixel is greater than zero to enter a lighting state, the backlight module is turned off before the transmittance of the second pixel reaches a minimum to enter a darkening state, and the backlight module keeps a first luminance in the lighting period of the backlight module.

20. The display according to claim 19, wherein the backlight module is turned on after the transmittance of the first pixel is greater than zero and before the second pixel has a maximum transmittance to enter the lighting state.

21. The display according to claim 19, wherein the backlight module is turned on after the second pixel has a maximum transmittance to enter the lighting state.

22. The display according to claim 19, wherein the backlight module is turned off after the first pixel has a maximum transmittance and before the transmittance of the second pixel reaches a minimum to enter the darkening state.

23. The display according to claim 15, wherein the lighting period of the backlight module comprises a first sub-period and a second sub-period, the backlight module keeps a first luminance in the first sub-period and the backlight module keeps a second luminance in the second sub-period.

24. The display according to claim 23, wherein the first luminance and the second luminance are different.

25. The display according to claim 15, wherein the lighting period of the backlight module comprises a first sub-period, a second sub-period, and a third sub-period, the second sub-period is between the first sub-period and the third sub-period, the backlight module keeps a first luminance in the first sub-period, the backlight module keeps a second luminance in the second sub-period, the backlight module keeps a third luminance in the third sub-period, and the second luminance substantially equals zero.

26. The display according to claim 25, the backlight module is turned on and off more than twice.

27. A method for driving a liquid crystal display, the liquid crystal display comprising a back light module and a pixel array having a first row of pixels and a second row of pixels, the method comprising:

(a) turning on a thin film transistor of a first pixel in the first row of pixels by a first scan signal and outputting a first pixel voltage to the first pixel in the first row of pixels to change a transmittance of the first pixel, and then outputting a second pixel voltage to a second pixel in the second row of pixels to change a transmittance of the second pixel;

(b) turning on the backlight module;

(c) adjusting a pixel electrode voltage of the first pixel at a first predetermined time point to lower a transmittance of the first pixel after outputting the first pixel voltage, after the first pixel reaches a maximum transmittance and before turning on the thin film transistor of the first pixel by a second scan signal next to the first scan signal; and (d) adjusting a pixel electrode voltage of the second pixel at a second predetermined time point to lower a transmittance of the second pixel after outputting the second pixel voltage and after the second pixel reaches a maximum transmittance, wherein the second predetermined time point is subsequent to the first predetermined time point, wherein when the first pixel voltage substantially equals the second pixel voltage, an integration of the transmittance of the first pixel over time in a lighting period of the backlight module is a first light intensity value and an integration of the transmittance of the second pixel over the time in the lighting period of the backlight module is a second light intensity value, and the difference between the first light intensity value and the second light intensity value is substantially smaller than 20% of the first light intensity value.

28. A liquid crystal display, comprising:

a backlight module; and a pixel array comprising:

a first row of pixels and a second row of pixels, a thin film transistor of a first pixel in the first row of pixels is turned on by a first scan signal to receive a first pixel voltage in order to change a transmittance of the first pixel, a second pixel of the second row of pixels receiving a second pixel voltage in order to change a transmittance of the second pixel, the first row of pixels and the second row of pixels being sequentially driven;

wherein a pixel electrode voltage of the first pixel is adjusted at a first predetermined time point to lower a transmittance of the first pixel after the first pixel receives the first pixel voltage, after the first pixel reaches a maximum transmittance and before the thin film transistor of the first pixel is turned on by a second scan signal next to the first scan signal, a pixel electrode voltage of the second pixel is adjusted at a second predetermined time point to lower a transmittance of the second pixel after the second pixel receives the second pixel voltage and after the second pixel reaches a maximum transmittance, and the second predetermined time point follows the first predetermined time point; and wherein when the first pixel voltage substantially equals the second pixel voltage, an integrated value of the transmittance of the first pixel over time in the lighting period of the backlight module is a first light intensity value, an integrated value of the transmittance of the second pixel over the time in the lighting period of the backlight module is a second light intensity value, and the difference between the first light intensity value and the second light intensity value is substantially smaller than 20% of the first light intensity value.

* * * * *